US012421683B1

(12) United States Patent
Sinclair

(10) Patent No.: US 12,421,683 B1
(45) Date of Patent: Sep. 23, 2025

(54) COUPLER FOR COUPLING DRIVEN STEEL PIPE PILES

(71) Applicant: John Lawrie, Inc., Houston, TX (US)

(72) Inventor: Victor Arthur Sinclair, Houston, TX (US)

(73) Assignee: John Lawrie, Inc., Houston, TX (US)

( * ) Notice: Subject to any disclaimer, the term of this patent is extended or adjusted under 35 U.S.C. 154(b) by 0 days.

(21) Appl. No.: 18/819,213

(22) Filed: Aug. 29, 2024

(51) Int. Cl.

| | |
|---|---|
| ***F16L 13/16*** | (2006.01) |
| ***B21D 39/04*** | (2006.01) |
| ***E02D 5/52*** | (2006.01) |
| ***F16L 13/14*** | (2006.01) |

(52) U.S. Cl.
CPC ..... *E02D 5/526* (2013.01)

(58) Field of Classification Search
CPC ..... E02D 5/285; E02D 5/48; E02D 5/526; E02D 2600/20; E02D 2200/1685; E02D 2250/0015; E02D 2300/0029; E04H 12/2269; F16L 13/14; F16L 13/141; F16L 13/146; F16L 13/147; F16L 13/16; B21D 39/04

See application file for complete search history.

(56) References Cited

U.S. PATENT DOCUMENTS

| | | | | |
|---|---|---|---|---|
| 10,617 | A * | 3/1854 | Young | F16L 21/002 285/397 |
| 964,052 | A | 7/1910 | Pflugh | |
| 1,886,275 | A | 11/1932 | Nell | |
| 3,466,738 | A | 9/1969 | Mount | |

(Continued)

FOREIGN PATENT DOCUMENTS

| | | |
|---|---|---|
| CA | 3184038 | 3/2024 |
| CN | 111021352 | 4/2020 |

(Continued)

OTHER PUBLICATIONS

Baert; Master Thesis—Analysis of the Installation of a Series of Piles for Offshore Wind Turbine Foundations, University of Rostock "EMSHIP" Erasmus Mundus Master Course "Integrated Advanced Ship Design", Feb. 2014; downloaded Mar. 20, 2023 from https://matheo.uliege.be/bitstream/2268.2/6136/1/BAERT%20%20Benjamin%20-%20%20URO%20%28Public%20Version%2C%20Feb%202014.pdf. 78 pages.

(Continued)

*Primary Examiner* — Amber R Anderson
*Assistant Examiner* — Stacy N Lawson
(74) *Attorney, Agent, or Firm* — Wells St. John P.S.

(57) ABSTRACT

A coupler for coupling together a lead pile segment and an extension pile segment of a driven pile comprises: a cylindrical pipe segment, having first and second formed ends and a cylindrical body extending therebetween, each of the first and second formed ends having an inner diameter that is greater than an inner diameter of the cylindrical body. The first formed end is sized to snugly receive an end of the lead pile segment and the second formed end is sized to snugly receive an end of the extension pile segment. Each of the first and second formed ends has an initial length. When an axial force is applied to the extension pile segment, each of the first and second formed ends undergo secondary end forming to thereby achieve a final length of each formed end, wherein the final length exceeds the initial length of each formed end.

12 Claims, 6 Drawing Sheets

(56) References Cited

U.S. PATENT DOCUMENTS

| | | | | |
|---|---|---|---|---|
| 3,724,223 | A * | 4/1973 | Pepe | E02D 13/10 29/523 |
| 3,762,173 | A | 10/1973 | Marsh | |
| 3,924,413 | A * | 12/1975 | Marsh, Jr. | E02D 5/523 405/251 |
| 4,302,874 | A | 12/1981 | Colas | |
| 4,569,617 | A | 2/1986 | Schmidt et al. | |
| 4,588,215 | A | 5/1986 | Moxham | |
| 4,645,247 | A | 2/1987 | Ward | |
| 4,769,897 | A | 9/1988 | Moseman | |
| 9,593,458 | B2 | 3/2017 | Satlow | |
| 9,631,768 | B1 | 4/2017 | Cote | |
| 11,851,840 | B1 | 12/2023 | Sinclair | |
| 2008/0063479 | A1 | 3/2008 | Stroyer | |
| 2008/0317556 | A1 | 12/2008 | Price | |
| 2016/0160466 | A1 | 6/2016 | Satlow | |
| 2016/0215470 | A1* | 7/2016 | Reusing | E02D 5/526 |
| 2019/0127940 | A1 | 5/2019 | Kaufman et al. | |

FOREIGN PATENT DOCUMENTS

| | | | | |
|---|---|---|---|---|
| DE | 20012860 | | 11/2000 | |
| GB | 2397327 | | 7/2004 | |
| GB | 2621301 | | 2/2024 | |
| JP | H11-13952 | | 1/1999 | |
| KR | 2021146086 | A * | 12/2021 | |
| NO | 170351 | | 6/1992 | |
| WO | WO 98/00609 | | 1/1998 | |
| WO | WO-9800609 | A1 * | 1/1998 | E02D 5/52 |

OTHER PUBLICATIONS

Chance Civil Construction—Hubbell Power Systems, Inc.; Chance Technical Design Manual Edition 4, Bulletin 01-0605/Revision Dec. 2018; downloaded Mar. 27, 2023 from https://web.archive.org/web/20220324000624/https://hubbellcdn.com/catalogfull/CHANCE%20Technical%20Design%20 Manual.pdf, 448 pages.

Chance Foundation Solutions; 2.875" Round Shaft Helical Extension(RS2875.203), 14×5ft, Catalog ID: C2784501CU; downloaded Oct. 17, 2022 from https://www.hubbell.com/chancefoundationsolutions/en/Products/Power-Utilities / Anchoring-Foundations/Helical-Anchors-Piles/ Extensions/2-875-Round-Shaft-Helical-ExtensionRS2875-203-14-x-5ft/p/2699253, 2 pages.

Chance Civil Construction; Design, Installation and Testing of Helical Piles & Anchors, presented by Donald A. Deardorff, P.E., Centralia, MO, USA; downloaded Oct. 17, 2022 from http://www.foundationperformance.org/pastpresentations/DeardorffPresSlides-8Apr09.pdf, 89 pages.

Chance Civil Construction; Foundations & Installing Tools for Transmission & Substations Catalog 4B Jul. 2017; downloaded Oct. 17, 2022 from https://hubbellcdn.com/catalogfull/04B-UtilityFoundations.pdf, 34 pages.

Clarke et al.; Development of a Swaged Pile/Sleeve Connection System for Application on a North Sea Jacket, Paper presented at the Offshore Technology Conference, Texas, Paper No. OTC-5772-MS; https://doi.org/10.4043/5772-MS; Published: May 2, 1988; downloaded Mar. 21, 2023 from https://onepetro.org/OTCONF/proceedings-abstract/88OTC/All-88OTC/OTC-5772-MS/49533, 6 pages.

Foundation Supportworks; Helical Piles and Anchors Hydraulically Driven Push Piers Polyurethane Injection Supplemental Support Systems—FSI Technical Manual, 2nd Ed. Jul. 2014; downloaded Mar. 23, 2023 from https://commercial.foundationsupportworks.com/core/ images/universal/fsi-tech-10-16/files/assets/common/downloads/publication.pdf. 372 pages.

Helical Pile; Versatile Steel Pile & Anchor System—E102-brochureHPA.01-00; downloaded Oct. 17, 2022 from https://helicalpile.asia/, 3 pages.

Hubbell; CHANCE® Combination (SS-RS) Helical Cast Transition, Geoengineer.org, The International Information Center for Geotechnical Engineers and related fields; downloaded Oct. 17, 2022 from https://www.geoengineer.org/news/hubbell-chance-combination-ss-rs-helical-cast-transition, 4 pages.

IMECO Austria; Ductile Iron Driven Piles; downloaded Oct. 17, 2022 from https://www.imeco.at/index.php?id=pil19, 1 page.

Kuhn et al.; Opti-OWECS Final Report vol. 2: Methods Assisting the Design of Offshore Wind Energy Conversion Systems; Jan. 1998, downloaded Oct. 18, 2022 from https://www.researchgate.net/publication/266455954_Opti-OWECS_Final_Report_Vol_2_Methods_Assisting_the_Design_of_Offshore_Wind_Energy_Conversion_Systems, 197 pages.

M&D Foundations; Steel Cased; downloaded Oct. 17, 2022 from https://mdfoundations.com/services/driven-piling/steel-cased/, 6 pages.

Magnum Piering; Helical Piers: Back to Basics, May 22, 2019; downloaded Oct. 17, 2022 from https://www.magnumpiering.com/2019/05/22/helical-piers-back-to-basics/, 4 pages.

Michael Tomlinson & John Woodward; Pile Design and Construction Practice (5th Ed.); downloaded Oct. 18, 2022 from https://menglim498.files.wordpress.com/2013/04/pile-design-and-construction.pdf, 564 pages.

Pile King; Helical Piles & Their Uses; downloaded Oct. 17, 2022 from https://pileking.net/helical-piles/, 7 pages.

Sarl Coulon Pieux Battus; Driven Ductile Cast Iron Piles; downloaded Oct. 17, 2022 from https://mdfoundations.com /services/driven-piling/steel-cased/, 16 pages.

Scira Offshore Energy Ltd.; Environmental Statement, May 2006; downloaded Mar. 21, 2023 from http://sheringhamshoal. co.uk/downloads/Offshore%20environmental%20statement.pdf, 722 pages.

Screwfast Foundations; Helical Piling; downloaded Oct. 17, 2022 from https://www.screwfast.com/foundation-solutions/helical-pile/, 8 pages.

Soil Testing, Inc.; What Is Construction Piling?; Sep. 27, 2016, downloaded Oct. 17, 2022 from https://www. soiltestinginc.net/2016/09/construction-piling/, 3 pages.

Substruck Ltd.; Driven Piles; downloaded Oct. 18, 2022 from https://substruck.ie/our-services/ground-engineering/driven-piles/, 5 pages.

Surefoot; Concrete Free Footing System brochure—downloaded Oct. 18, 2022 from https://surefootfootings.com.au/wp-content/uploads/2022/08/SUREFOOT-BROCHURE-low-res-1.pdf, 8 pages.

Sustatxa; Cost Analysis of Offshore Wind Turbine Support Structures, Monopile and Jacket—Thesis presented for the degree of Master of Philosophy 2011, University of Strathclyde, Naval Architecture and Marine Engineering Dept., downloaded Mar. 21, 2023 from https://stax.strath.ac.uk/concern/theses/47429913s?locale=en, 137 pages.

Van Gerven; Optimizing the Design of a Steel Substructure for Offshore Wind Turbines In Deeper Waters, Oct. 14, 2011, MSc Thesis—Delft University of Technology Faculty of Civil Engineering and Geosciences; downloaded Mar. 21, 2023 from https://repository.tudelft.nl/islandora/object/uuid%3Ad795483c-2255-4ad9-8295-79c134cale17, 183 pages.

* cited by examiner

COUPLER FOR COUPLING DRIVEN STEEL PIPE PILES

FIELD

The present disclosure relates to driven steel pipe piles; in particular, the disclosure relates to couplers for coupling together the steel pipe pile segments of a driven steel pipe pile.

BACKGROUND

Driven steel pipe piles are large metal pipes or tubes that are driven into the ground. Typical piles may have a circular cross-section and they come in segments of different lengths. In a given application, it may be required to drive multiple pile segments into the ground to achieve a desired piling depth that provides sufficient anchoring and stability for a building or other type of construction. When two or more pile segments are used, they are coupled together.

As the terms are used herein, a segment of pipe pile that is installed in the ground with one end of the segment protruding out of the ground (herein, an "exposed end") for coupling to a subsequent segment, is called the lead pile (or lead pile segment). A subsequent segment of pipe pile that is to be added to the lead pile segment installed in the ground is called an extension pile (or extension pile segment). For the avoidance of doubt, as the terms are used herein, a first segment installed into the ground is called a lead pile segment, and a second segment that is added to that first segment is called an extension pile segment. After coupling a second pile segment to a first pile segment, an axial force is applied to the second pile segment to thereby drive the second (extension) pile segment into the ground and the first (lead) pile segment is driven further into the ground, until only a short length of the extension pile segment extends above the ground. At this point, the second segment is called the "lead segment" and a new, third segment, to be coupled to the second segment, is called the "extension segment", when coupling the third segment to the second segment that is installed in the ground. A coupling apparatus and method is required for each extension pile segment that is added to a lead pile segment. The above-described terms for lead and extension piles (or otherwise referred to herein as pile segments) are used interchangeably throughout the present disclosure.

When coupling two pile segments of a driven pile, the coupling may need to resist lateral forces to achieve a straight, linear pile, as any bends or deflection of the pile underground may reduce the overall strength of the pile. Couplings which do not provide sufficient resistance to lateral forces may be subject to buckling or breakage during the installation process. Furthermore, the coupling between two driven pile segments may, in some applications, need to resist tension forces so that the coupled pile segments do not pull apart when an upward force is applied by the load at the uppermost connection to the pile. Once installed, the driven pile must be able to resist compressive, bending moment (lateral), and tension loads that may be applied to the top of the pile by the structure that is connected to the pile.

There are several conventional methods and devices for coupling together segments of driven piles. One method involves welding two pile segments together, as illustrated in FIG. 1A. This requires the exposed end 32 of the lead pile segment 30, driven into the ground, to be prepared for welding in the field. To prepare the exposed end 32 of the lead pile segment for welding, it is often necessary to cut off a portion of the exposed end to remove damage caused by the driving hammer. The exposed end of the lead pile may then be beveled to provide one half of the fillet required for welding to an end 21 of the extension pile segment. The extension pile segment 20 may be provided with a beveled edge, to eliminate the need to prepare this beveled edge in the field. A backing ring 2 is typically tack welded into the interior surface of the exposed end 32 of the lead pile, in the field, to provide a backing surface so that the weld does not blow through the inside wall of the pile. The extension pile segment 20 is then suspended in the air and positioned above the lead pile segment 30 by the pile rig, and then aligned with and placed on top of the exposed end 32 of the lead pile segment 30, which has the backing ring 2 installed. The pile rig then holds the extension pile segment 20 in place while the two pile segments are welded together in the field. Using the pile rig (otherwise referred to herein as a pile rig) to hold the extension pile segment 20 in place during the welding process may be costly, as the pile rig cannot be used to drive other piles into the ground until the welding is completed. In some cases, the extension pile may be initially tacked onto the lead pile, at which point the pile rig may safely release the upper end of the extension pile segment so that the pile rig may move away from that pile and work on other installations while the welding job is completed. However, in this case the pile rig would still travel back to this pile and reposition, once the welding is complete and driving is ready to resume. Such travel and repositioning also results in time where the pile rig is not installing piles, which may add to the overall cost of the project.

Another known method of coupling together two pile segments is to use a welded fit splice sleeve, as illustrated in FIG. 1B. This method uses a fabricated steel or cast steel sleeve 50 that has an inner diameter on both ends of the sleeve that is larger than the outer diameter of both the lead and extension pile segments, so that the exposed end of the lead pile segment and an end 21 of the extension pile segment may each be fitted into the opposite ends of the sleeve 50. The sleeve also includes an interior ledge 52 that extends from an interior wall of the sleeve 50, so that each of the ends 32, 21 of the lead and extension pile segments stop against the ledge 52. Typically, the sleeve 50 is firstly welded at weld seam 53 to an end 21 of the extension pile segment 20 off-site to reduce field welding costs. When it is time to add the extension pile segment 20, the exposed end of the lead pile segment (not shown in FIG. 1B) may need to be trimmed off, to remove damage caused by the driving hammer. The extension pile segment 20, with the sleeve 50 welded on, is then suspended by the pile rig above the exposed end of the lead pile segment so that the sleeve 50 at the end of the extension pile segment is aligned with and fitted over the exposed end of the lead segment. The pile rig suspends the extension pile segment in place while the bottom portion of the sleeve is welded, in the field, to the lead pile segment. Depending on the inner diameter of the sleeve 50, a gap 4 may result between the outer wall of the pile segment and the inner wall 51 of the sleeve 50. If this gap 4 is too large, a hinge point may be created such that lateral force resistance of the pile is diminished, resulting in movement of the pile laterally at the ground level and potentially resulting in pile instability. As a result, the structure loaded onto a pile that is coupled together using this method, may have lateral movement that exceeds what the design specification allows.

Another type of coupling is a drive fit splice sleeve, as illustrated in FIG. 1C. Similar to the welded fit splice sleeve described with reference to FIG. 1B, a drive fit splice sleeve 60 has an inner diameter on both ends of the sleeve that is larger than the outer diameter of both the lead and extension pile segments, so that the exposed end 32 of the lead pile segment and an end 21 of the extension pile segment may each be fitted into the opposite ends of the sleeve 60. However, the inner walls 61 of this sleeve 60 are tapered inwardly at both ends, extending towards a ledge 62, so that the inner diameter decreases towards the ledge 62 at both ends of the sleeve 60. The inner diameter of the sleeve 60, proximate the ledge 62, is smaller than the outer diameter of the pile segment that is being inserted into the sleeve. To install this type of coupling, the sleeve 60 is typically placed over the exposed end of the lead pile segment and is manually hammered to engage the tapered interior wall 61 with the exposed end of the lead pile, setting the sleeve in line with a central axis of the lead pile segment. Then, the pile rig positions and inserts the extension pile segment 20 into the opposite end of the sleeve 60. Once the end 21 of the extension pile segment 20 is inserted into the sleeve 60, the pile rig applies a driving force to the driven end of the extension pile segment to drive the opposite end of the extension pile segment deeper into the tapered section of the sleeve 60 until the respective ends of each pile segment abuts against the ledge 62 within the sleeve 60. Although this coupling method does not require field welding, this coupling method does not provide tension resistance and therefore the extension pile segment may pull out of the sleeve if an upward force is applied. Additionally, the coupling sleeve 60 may be difficult to align with the ends of the pile segments. If misalignment occurs, it may cause a slight curve in the installed pile underground. Furthermore, the short depth of the coupler and the lack of welding may create a hinge point that does not resist lateral loads applied to the top end of the pile, resulting in excessive lateral movement at the top of the pile.

A further coupling method utilizes a prefabricated rebar cage 55, an example of which is illustrated in FIG. 1D. A first end 55*a* of the rebar cage 55 is inserted inside the exposed end of the lead pile segment (not shown in FIG. 1D), and an opposite end 55*b* of the rebar cage extends out of the exposed end of the lead pile segment. Then, the extension pile segment (not shown) is lifted into place by the pile rig and fitted over the protruding end 55*b* of the rebar cage 55. The rebar cage 55 aligns the two ends of the pile segments to be coupled, while the extension pile segment is driven into the ground by the pile rig. The rebar cage includes small tabs (not shown), or a tube section 55*c* attached to the rebar cage, which sits on top of the exposed end of the lead pile segment to prevent the rebar cage from falling into the lead pile segment. These tabs or the tube 55*c* create a small gap between the two coupled pile segments. In most cases, this coupling method requires the installation of concrete inside the extension pile segment to solidify the coupling of the two pile segments. The rebar cage 55, on its own, does not provide any tension force resistance or lateral force resistance. The addition of the concrete increases the overall cost of installation and may be time consuming.

Another coupling method involves a ductile iron pipe spigot and socket system, an example of which is illustrated in FIG. 1E. This consists of cast ductile iron pipe segments that have a spigot 57 opening at one end and a socket 58 opening at the opposite end. The lead pile segment 30 includes a socket 58 at the exposed end of the pile. When an extension needs to be added, the spigot end 57 of the extension pile segment 20 is inserted into the socket end 58 of the lead pile segment 30. The socket end 58 includes a slight taper on the inner walls extending towards an inner ledge, and the spigot end 57 of the extension pile segment 20 abuts against this ledge during insertion. This tapered coupling method couples the two pile segments together, but does not provide any tension resistance, unless some form of reinforcement is added to the pile, such as concrete, grout, tension cables or rods. Therefore, the extension pile segment 20 will pull out of the lead pile segment 30 if an upward force is applied, in the absence of adding any reinforcement to the installed pile. The relatively short depth of the coupling and the lack of welding create a hinge point that does not resist lateral loads applied to the upper end of the pile segment, resulting in excessive lateral movement of the top of the pile. Furthermore, the pre-cast piles, including the spigot and socket ends, are typically more expensive to manufacture as compared to structural pipe typically used for piles. For applications requiring tension resistance, there is a significant additional cost of adding reinforcement to the pile (such as concrete, steel cables, etc.). As well, the Applicant has found that the lead and extension pile segments featuring the spigot and socket ends are limited in length, requiring more segments and more couplings to reach the desired pile depths, which may thereby increase the cost of the final installed pile. Additionally, ductile iron is difficult to weld, and welding ductile iron may result in weld stress and cracking that occurs during welding or cooling. As a result, this coupling method may not be capable of providing full tension load resistance.

In U.S. Pat. No. 3,724,223 to Pepe (the "'223 Patent"), a drive fit closure cap for pipe piles, formed of a pan having tapered upright sides, is disclosed. The tapered sides of the pan led the pipe into the pan and thereby reduce the pipe diameter to a smaller diameter, to thus form a self locking joint for pile driving. The pan may be provided with an internal annular ring, which may retain gasket or sealant material, or may be sized to be a drive fit on the inside of the pipe while the tapered sides of the pan form a drive fit on the outside of the pipe. A drive fit sleeve, for joining two pipe piles formed of two fit closure caps joined bottom-to-bottom, and having the pan's base centers blanked out, is also disclosed. The closure caps, as disclosed in Pepe, are formed from a flat piece of steel or other metal placed over a die, and a punch is moved downwards, as shown in FIGS. 1 to 3 of the '223 Patent.

Applicant is also aware of U.S. Pat. No. 9,593,458 to Tiroler Rohre GmbH (the "'458 Patent"). The '458 Patent describes a driven pile comprising a substantially cylindrical shaft, the shaft having first and second pile ends, and a socket that is arranged on the driven pile in the region of the second pile end.

The socket or the driven pile has an abutment in the region of the second pile end, so that a further driven pile may be inserted with a first pile end as far as a maximum insertion depth defined by the abutment. The socket and/or the driven pile in the region of the second pile end provides at least one undercut portion extending at least substantially to the abutment. The first pile end inserted into the socket deforms while being driven, conforming to the undercut portion of the socket in the region of the abutment when a driving force is applied. Although this coupling method couples the two pile segments together, it is the Applicant's opinion that this coupling method provides a limited or no level of tension load resistance, and that the extension pile segment may pull out of the lead pile segment if a tension load is applied to the pile. Additionally, in the Applicant's view, the relatively short depth of the coupling and the lack of welding may create a hinge point that offers minimal or no resistance to lateral loads applied to the upper end of the pile segment, which may result in excessive lateral movement of the top of the installed pile.

Applicant is additionally aware of U.S. Pat. No. 3,466,738 to Mount (the "'738" Patent). The '738 Patent discloses a pipe having a slightly flared end coupled to another pipe, wherein the flared outer pipe expands so that its final outside diameter is substantially equal to the sum of the original outside diameter of the inner pipe plus twice the wall thickness of the outer pipe. The inner pipe substantially holds its shape except for the slight swaging of a leading edge. Since the enlargement of the diameter of the outer pipe is created by an axial force applied to force one pipe inside the other, the longer the overlap, the greater the elastic grip of the outer pipe on the inner pipe.

Applicant's own U.S. Pat. No. 11,851,840 (the "'840 Patent") discloses a coupling between a lead pile segment and an extension pile segment, wherein the extension segment has a formed end, an opposite driven end and a body extending therebetween. The formed end has an inner diameter equal to an outer diameter of an exposed end of the lead segment and greater than an outer diameter of the extension pile segment's body. The formed end has an initial length prior to coupling the extension and lead pile segments. The formed end undergoes secondary end forming when a driving force is applied, such that the formed end has a final length exceeding the initial length after the extension and lead pile segments are coupled together. Furthermore, the extension pile segment has an external ring portion positioned upstream of the formed end, and the exposed end of the lead pile segment is cold extruded into and through the external ring portion of the extension pile segment. Thus, the pile segments themselves are each provided with a formed end at one end of the pile segment, and an external ring positioned upstream of the pile's formed end, such that the formed end of an extension pile segment couples with the exposed end of the lead pile segment when the axial force is applied to an opposite end of the extension pile segment.

An issue with the pile couplings that is shared in common between at least the '458, '738 and '840 Patents is that specially manufactured pile segments are required for coupling together a plurality of the pile segments. If there is a shortage of the specialized pile segments during a pile installation, work may be delayed until more pile pipe segments comprising the specialized coupling feature can be manufactured and delivered to the site. Furthermore, it is often convenient and cost efficient to use scrap or leftover pipe pile segments, which segments are regular pipe segments that typically lack the special features disclosed in the '458, '738 and '840 Patents for coupling the pile segment together with other segments. Therefore, one cannot couple together regular pipe pile segments using the pile segments and methods described in the above-noted patent references.

It is desirable to have a relatively quick and inexpensive method for coupling together pile segments in the field, providing a strong and inexpensive coupling that resists not only compressive loads, but also lateral (bending moment) forces and/or tension forces, with minimal or no field welding. Additionally, it is desirable to have a coupler which may be used with regular pile segments, rather than requiring each pile segment to include a coupling feature.

SUMMARY

To address some of the shortcomings of the existing prior art pile couplings, improved pile couplers are disclosed herein. In particular, the couplers disclosed herein may be advantageous for piling jobs that have started with standard pipe, and subsequently it is determined that pile extensions are required. With the original pile segments already purchased and on-site, the couplers disclosed herein provide a low cost and effective solution for installing piles of varying lengths and diameters, while also providing the lateral and tension resistance required for the construction specifications. Furthermore, the couplers disclosed herein are self-aligning during installation, such as by providing a deep formed end. Therefore, advantageously, an extension pile segment may be set into the coupler and if the piling rig needs to then be moved before driving the extension pile, the extension pile may be left unsupported without falling over, which thereby offers greater flexibility for using the piling rig during an installation job.

In some embodiments of the present disclosure, an improved pile coupler comprises a cylindrical pipe segment having first and second formed ends, the formed ends each sized to receive an end of a lead or extension pile segment. When an axial force is applied to the extension pile segment, the ends of the lead and extension pile segments are each pushed further into the coupler, causing secondary end forming to occur, which provides for a coupling that resists compressive, lateral and tension forces.

In some embodiments, an external ring may be welded, or otherwise affixed, to the external surface of the coupler, adjacent to either one or both of the formed ends of the coupler. In such embodiments of the coupler, when an axial force is applied to the extension pile segment and the ends of the lead and extension pile segments are forced further into the coupler, a combination of secondary end forming and/or cold extrusion of the ends of the lead and/or extension pile segments, will occur through the ring section of the coupler. The combination of secondary end forming and/or cold extrusion that occurs, when a driving force is applied to the extension pile segment, may produce a pile coupling with increased resistance to compressive, tension and lateral forces.

In some embodiments, the coupler may comprise a plate located between the first and second formed ends of the cylindrical pipe segment. In such embodiments, the cylindrical pipe segment may comprise first and second cylindrical pipe segments that are each welded to opposing sides of the plate, with the opposite, free ends of each of the first and second cylindrical pipe segments having a formed end. As in the other embodiments, the formed end of each of the first and second cylindrical pipe segments is sized to receive an end of a lead or extension pile segment. When an axial force is applied to the extension pile segment and the ends of the lead and extension pile segments are forced further into the coupler towards the plate, secondary end forming occurs which provides for the resulting pile coupling to have increased resistance to compressive, tension and lateral forces.

Furthermore, in the embodiments of the coupler including a plate, the distance of travel of the ends of the extension and lead pile segments may be limited by the plate, such that the end of the lead or extension pile segment will stop moving through the coupler when it is in close proximity to the plate. The applicant hypothesizes that the weld on the external surface of the pipe, attaching the cylindrical pipe segment to the plate, halts the further radial expansion of the cylindrical pipe body and thus stops the secondary forming process. The welding of two cylindrical pipe segments to a central plate may therefore control the distance that each of the lead and extension pile segments will be inserted into the coupler. Controlling the distance that a pile segment will be inserted into a coupler may be desirable in certain applications, and furthermore, the plate feature prevents one pile segment from being inserted much farther into the coupler as compared to the other pile segment. Additionally, when the end of a pile segment reaches a position that is in close proximity to the plate, the plate may bear at least some of the axial load applied to the pile, which may increase the overall load that may be supported by the installed pile. Some embodiments of the coupler having a plate may also include one or more external rings welded to an external surface of the coupler, as described above.

Advantageously, the couplers described herein are relatively simple and inexpensive to manufacture, and may be manufactured of scrap metal, including scrap metal plates and leftover pipe segments. Furthermore, the couplers described herein are fully customizable, with different optional features that may provide for higher compressive, lateral and/or tension loads to be applied to the installed pile, as may be required for a given application. Furthermore, due to the relative ease of manufacturing and customizing the couplers described herein, the couplers may be ordered and custom-fabricated after a piling job has started, with the couplers designed to meet the needs of the soil conditions at the building site. Furthermore, it may be cost effective to have a large number of couplers readily on hand for a pile installation, providing for flexibility when adapting the pile installation to the conditions presented at the construction site.

In one aspect of the present disclosure, a coupler for coupling together a lead pile segment and an extension pile segment of a driven pile is provided. The coupler comprises: a cylindrical pipe segment, having first and second formed ends and a cylindrical body extending therebetween, each of the first and second formed ends having an inner diameter that is greater than an inner diameter of the cylindrical body. The first formed end is sized to snugly receive an end of the lead pile segment and the second formed end is sized to snugly receive an end of the extension pile segment. In some embodiments, each of the first and second formed ends has an initial length, and when an axial force is applied to the extension pile segment, each of the first and second formed ends of the coupler undergo secondary end forming to thereby achieve a final length of each formed end, wherein the final length of each formed end exceeds the initial length of each formed end.

In some embodiments, the coupler comprises first and second external rings, the first external ring affixed to an external surface of the cylindrical body and proximate to the first formed end and the second external ring affixed to the external surface of the cylindrical body and proximate to the second formed end of the coupler. When an axial force is applied to the extension pile segment to drive the ends of the lead and extension pile segments into the coupler, the end of the lead pile segment is cold extruded through a section of the cylindrical body that is encircled by the first external ring and the end of the extension pile segment is cold extruded through a section of the cylindrical body that is encircled by the second external ring. In some embodiments of the coupler, the first external ring is affixed to the external surface of the cylindrical body and adjacent to, so as to abut against, the first formed end, and the second external ring is affixed to the external surface of the cylindrical body and adjacent to, so as to abut against, the second formed end.

In some embodiments, a coupler for coupling together a lead pile segment and an extension pile segment of a driven pile comprises first and second cylindrical pipe segments, wherein each segment of the first and second cylindrical pipe segments comprises a formed end and an opposite plate end, wherein the plate end of each of the first and second cylindrical pipe segments is affixed to opposing sides of a plate, the plate having a diameter approximately equal to an outer diameter of the pipe end of each of the first and second cylindrical pipe segments. An inner diameter of the formed end of the first cylindrical pipe segment exceeds an inner diameter of the plate end of the first cylindrical pipe segment and an inner diameter of the formed end of the second cylindrical pipe segment exceeds an inner diameter of the plate end of the second cylindrical pipe segment. The formed end of the first cylindrical pipe segment is sized to snugly receive an end of the lead pile segment and the formed end of the second cylindrical pipe segment is sized to snugly receive an end of the extension pile segment.

In some embodiments, each of the first and second formed ends has an initial length, and wherein when an axial force is applied to the extension pile segment, each of the first and second formed ends of the coupler undergo secondary end forming to thereby achieve a final length of each formed end, wherein the final length of each formed end exceeds the initial length of each formed end.

In some embodiments, when the axial force is applied to the extension pile segment, at least one end of the lead or extension pile segments travels towards the plate until an external weld seam affixing the plate end of the first or second cylindrical pipe segments prevents radially outward expansion of a pipe wall of the respective first or second cylindrical pipe segments.

In some embodiments, the inner diameter of the formed end of the first cylindrical pipe segment is greater than or less than the inner diameter of the formed end of the second cylindrical pipe segment.

In some embodiments, the coupler comprises first and second external rings, the first external ring affixed to an external surface of the first cylindrical pipe segment between the plate and the first formed end and the second external ring affixed to an external surface of the second cylindrical pipe segment between the plate and the second formed end. When an axial force is applied to the extension pile segment to drive the ends of the lead and extension pile segments toward the plate, the end of the lead pile segment is cold extruded through a section of the first cylindrical pipe segment that is encircled by the first external ring and the end of the extension pile segment is cold extruded through a section of the second cylindrical pipe segment that is encircled by the second external ring. In some embodiments, the first external ring is affixed to the external surface of the first cylindrical pipe segment and adjacent to, so as to abut against, the first formed end, and the second external ring is affixed to the external surface of the second cylindrical pipe segment and adjacent to, so as to abut against, the second formed end.

DETAILED DESCRIPTION

Figure 2B:
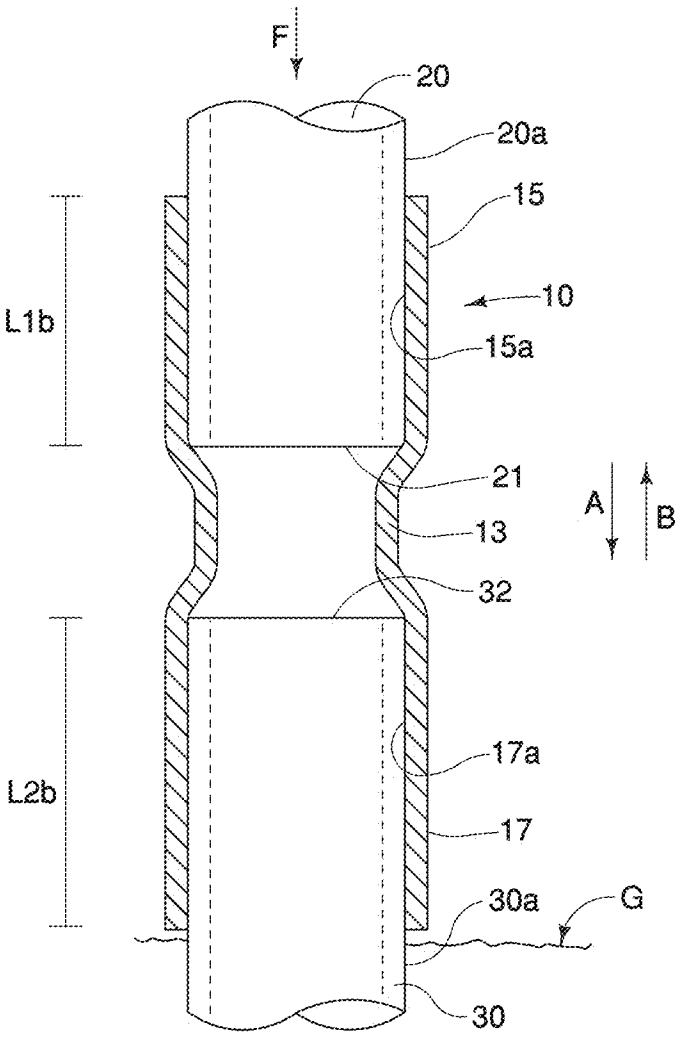
FIG. 2B is a sectional view of the embodiment of a pile coupler illustrated in FIG. 2A, where application of a driving force to the extension pile segment has resulted in secondary end forming at the first and second opposite formed ends of the coupler.
Figure 2A:
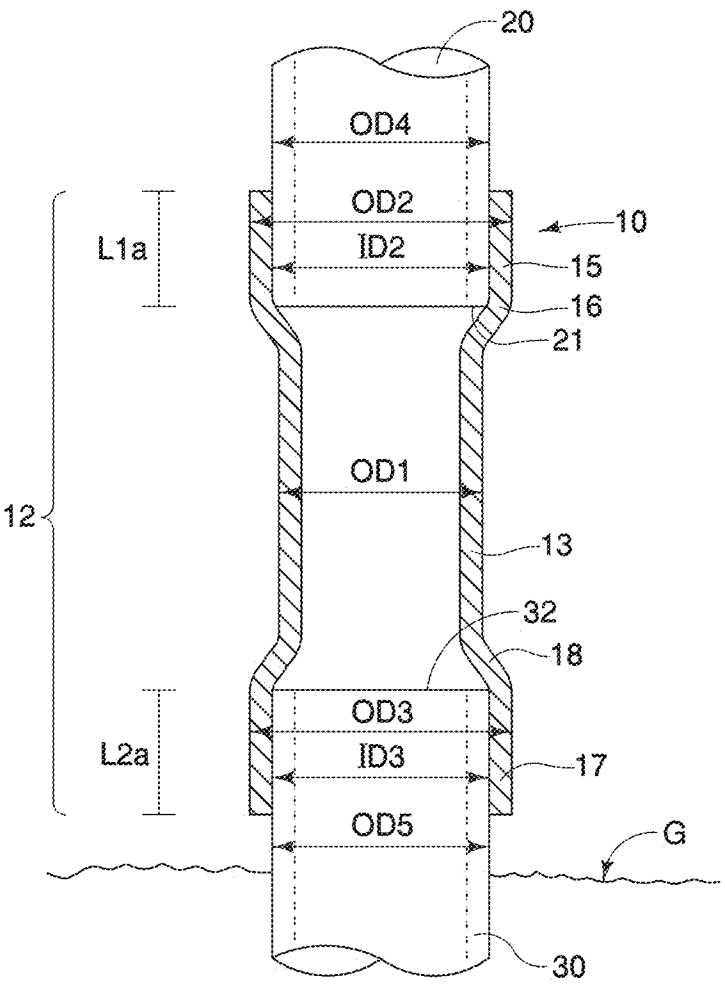
FIG. 2A is a sectional view of the ends of lead and extension pile segments inserted into opposite ends of an embodiment of a pile coupler, the pile coupler comprising a cylindrical pipe segment with first and second opposite formed ends.

As shown in FIGS. 2A and 2B, an embodiment of the pile coupling 10 of the present disclosure comprises a cylindrical pipe segment 12. The cylindrical pipe segment 12 has opposite first and second formed ends 15, 17, and a cylindrical body 13 extending therebetween. The cylindrical body 13 has an outer diameter OD1, and each of the formed ends 15, 17 have an outer diameter OD2, OD3, respectively. The outer diameters OD2, OD3 of the formed ends 15, 17 are greater than the outer diameter OD1 of the cylindrical body 13. The formed end 15 smoothly transitions to the cylindrical body 13 of the cylindrical pipe segment 12 with a smooth, radiused bend 16. Likewise, the formed end 17 smoothly transitions to the cylindrical body 13 of the cylindrical pipe segment 12 with a smooth, radiused bend 18.

The inner diameter ID2 of the formed end 15 is sized to snugly receive the end 21 of the extension pile segment 20. For example, the inner diameter ID2 of the formed end 15 may be equal to, or approximately equal to, the outer diameter OD4 of the extension pile segment 20, so that the formed end 15 of the coupler 10 snugly receives the end 21 of the extension pile segment 20. Likewise, the inner diameter ID3 of the formed end 17 may be equal to, or approximately equal to, the outer diameter OD5 of the lead pile segment 30, so that the formed end 17 of the coupler 10 snugly receives the exposed end 32 of the lead pile segment 30, the exposed end 32 of the lead pile segment 30 protruding from the ground G. Although the embodiment illustrated in FIGS. 2A and 2B shows that the outer diameters OD4, OD5 of the extension and lead pile segments are approximately equal, and the inner diameters ID2, ID3 of the formed ends 15, 17 are approximately equal, it will be appreciated that the couplers disclosed herein may be configured for coupling together pile segments having different outer diameter measurements. In such embodiments (not shown), the coupler 10 would be manufactured so that the inner diameters ID2, ID3 of the formed ends 15, 17 are appropriately sized to receive the outer diameters of the lead and extension pile segments that are to be coupled together. Likewise, throughout the rest of this description, it will be appreciated that the formed ends 15, 17 of the different embodiments of a coupler 10 may have inner and outer diameters, respectively, that are equal to each other (in cases where two pile segments to be coupled together have equal diameters). In other embodiments, the formed ends 15, 17 of the different embodiments of a coupler described herein may have inner and outer diameters, respectively, that are not equal to each other (in cases where the two pile segments to be coupled together have different diameters).

FIG. 2B shows the movement of the ends 21, 32 of the extension and lead pile segments 20, 30 towards one another and through the coupler 10, after an axial driving force F has been applied to the driven end (not shown) of the extension pile segment 20. As shown in FIG. 2B, after an axial driving force F has been applied, the ends 21, 32 of the extension and lead pile segments 20, 30 are closer to one another, as compared to FIG. 2A. As well, a final length L1*b* of the formed end 15 and a final length of L2*b* of the formed end 17 have each increased, as compared to the initial lengths L1*a*, L2*a* of the formed ends 15, 17 shown in FIG. 2A.

Due to the application of the axial driving force F to the driven end of the extension pile segment 20, the force F has pushed the end 21 of the extension pile segment 20 into coupler 10, so that the end 21 progresses axially further into the coupler 10. This movement of the end 21 into the coupler 10 causes the radial deformation of the walls of the cylindrical pipe segment 12, a process referred to herein as "secondary end forming". The secondary end forming process thereby increases the initial length L1*a* of the first formed end 15 to a final length L1*b*. The Applicant has discovered that secondary end forming in the coupler 10 occurs above a certain threshold value of the axial force F that is applied to the extension pile segment 20. The threshold value is strongly correlated to the yield strength of the material of the pipe (or pipes) used to manufacture the coupler 10. The threshold value is also strongly correlated to the ratio of the diameter of the pipe segment (D) to the thickness of the wall of the pipe (t) used to manufacture the coupler 10. Generally speaking, the threshold value of the axial force F for initiating the secondary end forming process in the coupler 10, during installation of an extension pile segment using the couplers 10 described herein, will increase when a higher yield strength pipe is used to manufacture the coupler 10. Furthermore, a greater thickness (t) of the pipe used to manufacture the coupler 10 will also increase the threshold value of the axial force F required to initiate secondary end forming in the coupler 10 during installation of an extension pile segment.

Furthermore, the end 21 of the extension pile segment 20 pushes on the radiused bend 16, and the frictional force between the exterior surface 20*a* of the end of the extension pile segment 20 and the interior surface 15*a* of the formed end 15 of the coupler, transmit the driving force F to the coupler 10 to move the coupler 10 towards the ground G. The driving force F causes the end 32 of the lead pile segment 30 to exert a force on the radiused bend 18 of the formed end 17, thereby radially deforming the walls of the cylindrical pipe segment 12 as the end 32 of the lead pile segment 30 pushes further into the coupler 10. This also causes secondary end forming that increases the initial length L2*a* of the second formed end to a final length L2*b*. For example, not intended to be limiting, the secondary end forming process may result in increasing the initial lengths La, L2*a* of each of the formed ends 15, 17, shown in FIG. 2A, by a distance of approximately six to twelve inches (15 cm to 30 cm), to arrive at the final length L1*b*, L2*b* of the formed ends 15, 17 shown in FIG. 2B. Furthermore, the frictional force between the exterior surface 30*a* of the end of the lead pile segment 30 and the interior surface 17*a* of the formed end 17 of the coupler, and the frictional force between the exterior surface 20*a* of the end of the extension pile segment 20 and the interior surface 15*a* of the formed end 15 of the coupler, increases with the increased lengths L1*b*, L2*b* of the formed ends 15, 17, which provides increased lateral and tension force resistance of the pile coupling. Such lateral and tension resistance of the resulting coupling may be obtained, in some embodiments, without any welding between the pile segments and the coupler 10.

As the driving force F continues to be applied to the driven end of the extension pile segment 20, both the lead and extension pile segments 30, 20 are driven further into the ground G while at the same time providing for tighter coupling of the segments 20, 30, as the exposed ends 21, 32 of the extension and lead pile segments 20, 30 move further into the coupler 10.

The Applicant has found that the secondary end forming process, whereby the initial length L1*a*, L2*a* of each of the formed ends 15, 17 of the coupler 10 is increased to reach a final length L1*b*, L2*b*, which provides for a stronger coupling with increased frictional resistance to compressive, lateral and tension loads, as compared to other coupling methods. With this increased frictional resistance, the extension pile segment 20 resists being pulled apart upwardly in direction B, bending laterally, or compressing downwardly in direction F once the pile installation has been completed to design specifications.

Figure 1C:
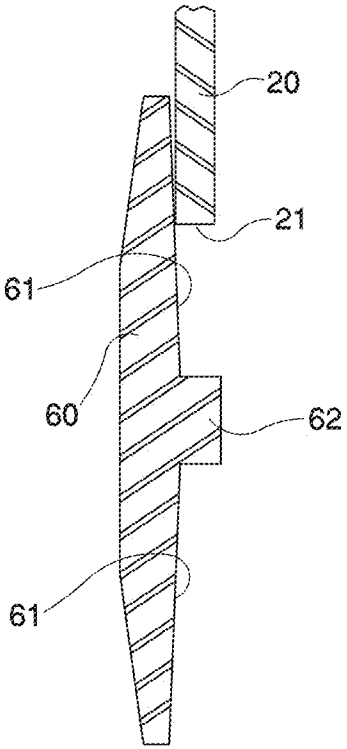
FIG.1C (PRIOR ART)
FIG. 1C is a sectional view of a prior art pile coupling comprising a drive fit splice sleeve.
Figure 1B:
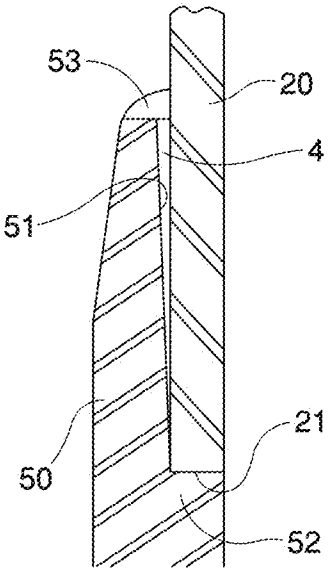
FIG.1B (PRIOR ART)
FIG. 1B is a sectional view of a prior art pile coupling comprising a welded fit splice sleeve.
Figure 1A:
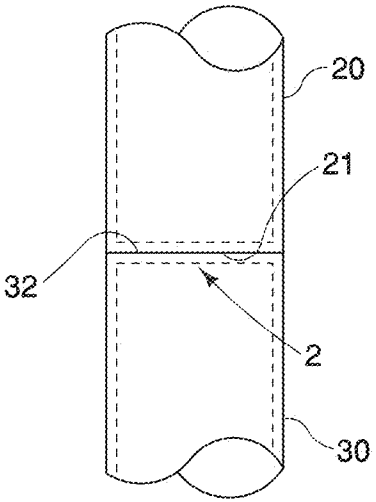
FIG.1A (PRIOR ART)
FIG. 1A is a profile view of a prior art pile coupling wherein the two pile segments are spliced together by welding and using a reinforcing backing ring.
Figure 1E:
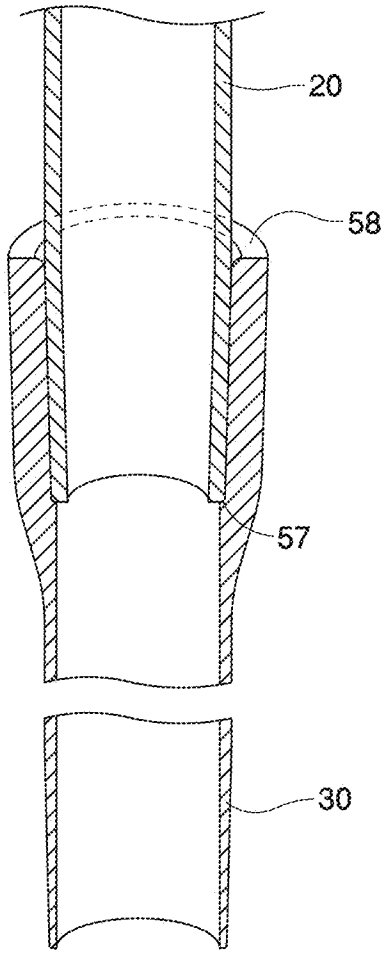
FIG.1E (PRIOR ART)
FIG. 1E is a sectional view of a prior art pile coupling comprising a spigot and socket coupler manufactured of ductile iron.
Figure 1D:
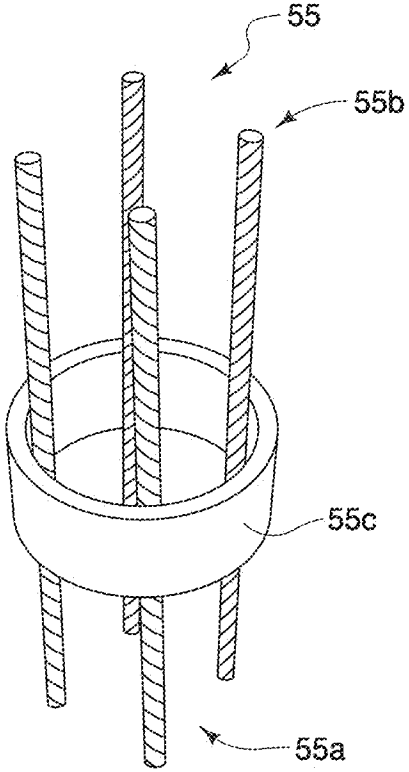
FIG.1D (PRIOR ART)
FIG. 1D is a perspective view of a prior art pile coupling comprising a rebar cage.

Optionally, after the driving force F has been applied but before the coupler 10 is driven beneath the surface of the ground G, a fillet weld (not shown) may be applied at ends 15 and 17, at the junction with the lead pile segment 30 and the extension pile segment 20, to provide additionally increased resistance to tension forces applied to the extended pile in direction B. Thus, in such embodiments, once a fillet weld is applied to the coupler 10 at either end connection coupler 10 to pile segments 20 and 30, no additional secondary end forming would occur, and the formed end serves the function of fitting over the exposed end 32 of the lead segment. Although the optional installation method of applying a fillet weld involves field welding, the Applicant finds such field welding is minimal as compared to other coupling methods known in the art. Furthermore, applying fillet weld avoids the cost of requiring a pre-manufactured coupling sleeve added to the pile segments, as is known in the prior art and shown, for example in FIGS. 1B and 1C.

Figure 3B:
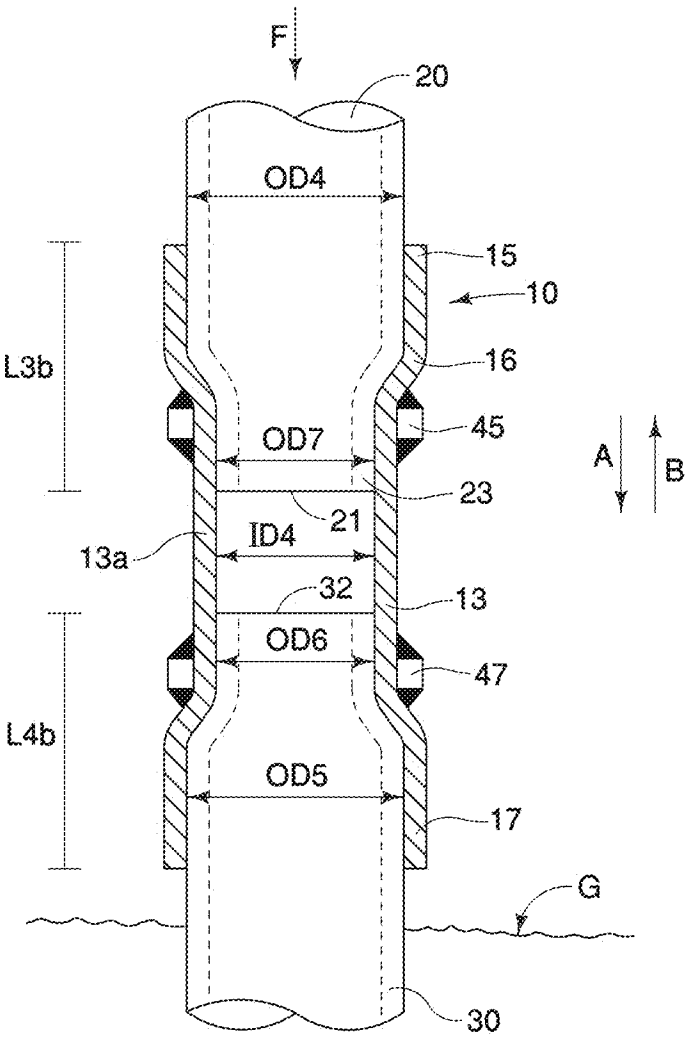
FIG. 3B is a sectional view of the embodiment of a pile coupler illustrated in FIG. 3A, where application of a driving force to the extension pile segment has resulted in secondary end forming and cold extrusion through the external ring sections at the first and second opposite formed ends of the coupler.
Figure 3A:
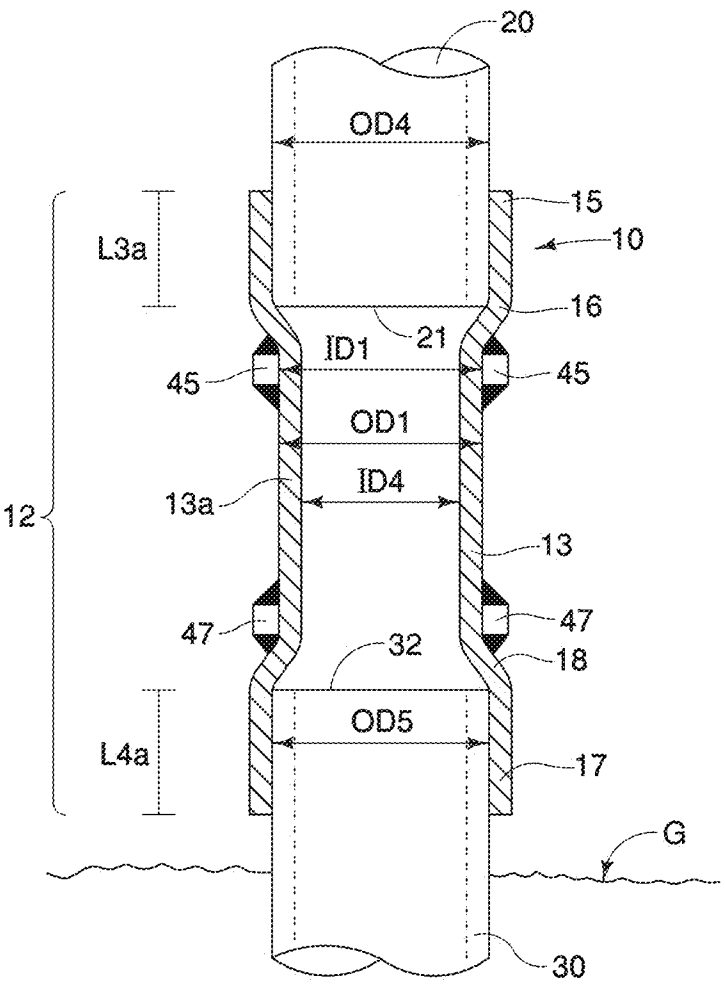
FIG. 3A is a sectional view of the ends of lead and extension pile segments inserted into opposite ends of a further embodiment of a pile coupler, the pile coupler comprising a cylindrical pipe segment with first and second opposite formed ends and first and second external rings positioned adjacent to the first and second opposite formed ends.

In the embodiment illustrated in FIGS. 3A and 3B, the coupler 10 further comprises external affixed or welded ring portions. The illustrated embodiment, for example, includes two external rings 45, 47, which is a metal ring having an inner diameter ID1 that is approximately equal to an outer diameter OD1 of the cylindrical body 13 of the cylindrical pipe segment 12, such that the external rings 45, 47 encircle the cylindrical body 13. In the illustrated embodiment of FIGS. 3A and 3B, the external rings 45, 47 are positioned adjacent to the radiused bends 16, 18 of the first and second formed ends 15, 17. However, in other embodiments (not illustrated), the external rings 45, 47 may be positioned on the cylindrical body 13 at a distance from the radiused bends 16, 18, which configuration would allow additional secondary end forming to occur when the driving force F is applied to the extension pile segment 20. The coupler 10 may thus be configured in different ways to provide for different properties of the pile coupling, such as providing for additional tension, compression or lateral (bending moment) resistance, or to control for the extent of secondary end forming that occurs or the distance that the pile segments are driven into the coupling 10 during installation.

When an axial driving force F is applied to the extension pile segment 20, as shown in FIG. 3B, the end 21 of the extension pile segment will travel downwards in direction A such that the extension pile segment 20 is driven farther into the coupling 10. However, because the external ring 45 exerts radial tension against the exterior surface 13*a* of the cylindrical body 13, the walls of the cylindrical body 13 resist radially outward deformation at the location of the external ring 45. Thus, the secondary end forming process is prevented up to a threshold driving force applied by the piling rig hammer. If the driving force is increased beyond that threshold, the end 21 of the extension pile segment 20 will begin to compress radially inwardly, and extrude through the inner diameter ID4 of the cylindrical body 13 of the coupler 10, as shown in FIG. 3B. The resulting extruded portion 23 of the end 21 of the extension pile segment 20 has an outer diameter OD7 that is approximately equal to the inner diameter ID4 of the cylindrical body 13 of the coupler 10. Furthermore, a final length L3*b* of the overlapping portion between the extension pile segment 20 and the coupler 10, shown in FIG. 3B, is greater than the initial length L3*a* of the overlapping portion between the extension pile segment 20 and the coupler 10, shown in FIG. 3A.

Advantageously, and likewise, when the axial driving force F is applied to the extension pile segment 20, because of the external ring 47 exerting radial tension against the exterior surface 13*a* of the cylindrical body 13, the walls of cylindrical body 13 resist radially outward deformation, and thus secondary end forming is prevented up to a threshold driving force. However, if the driving force is increased beyond that threshold, the coupler 10 moves downward in direction A, and the exposed end 32 of the lead pile segment 30 moves further into the coupler 10 by starting to compress radially inwardly to thereby extrude through the inner diameter ID4 of the cylindrical body 13 of the coupler 10. A final length L4*b* of the overlapping portion between the lead pile segment 30 and coupler 10, shown in FIG. 3B, is greater than the initial length L4*a* of the overlapping portion between the lead pile segment 30 and the coupler 10, shown in FIG. 3A. The resulting extruded portion 33 of the end 32 of the lead pile segment 30 has an outer diameter OD6 that is approximately equal to the inner diameter ID4 of the cylindrical body 13 of the coupler 10. Applicant has discovered that this extrusion action greatly increases the friction resistance between the outer walls of the extension segment 20 and the lead segment 30, and the inner wall of coupler 10, providing a further increase in the resistance of the coupling to compressive, lateral (bending moment) and tension loads applied to the installed pile. Additionally, the Applicant hypothesizes that the dual overlapping areas between pile segments and the coupler, created through the extrusion process, lend additional resistance of the installed coupling to compressive, lateral (bending moment) and tension loads applied to the installed pile. A further advantage of the two areas of overlap, as between the lead and extension pile segments 30, 20 and the coupler 10, is that such dual areas of overlap and frictional engagement allows for higher capacities of the installed pile using shorter couplers, with less secondary forming and/or cold extrusion distance required to attain such higher capacity of the installed pile to resist compressive, lateral and tension loads applied to the installed pile, as compared to coupling methods that involve only a single area of overlap between the coupler and the lead or extension pile.

In further embodiments, with reference to FIGS. 4 to 6B, a coupler 10 has opposite first and second formed ends with a plate inserted between the first and second formed ends. In one such embodiment, illustrated in FIG. 4, the coupler 10 comprises first and second cylindrical pipe segments 14, 19. Each cylindrical pipe segment has a formed end 14*a*, 19*a* and an opposite plate end 14*b*, 19*b*, the plate ends 14*b*, 19*b* each welded to opposite planar surfaces of a central plate 40. Each cylindrical pipe segment 14, 19 also has a body portion 14*c*, 19*c*, the body portion 14*c*, 19*c* each having an outer diameter OD10 that is less than an outer diameter OD11 of the corresponding formed end 14*a*, 19*a*.

In use, the end 21 of the extension pile segment 20 and the exposed end 32 of the lead pile segment 30 are each inserted into the respective formed ends 14*a*, 19*a* before a driving force is applied to the extension pile segment 20. Although not shown in the example embodiment of FIG. 4, when a driving force is applied to the extension pile segment 20, a secondary end forming process may occur as the end 21 of the extension pile segment 20 pushes past the radiused bend 16, driving the end 21 of the extension pile segment 20 further into the coupler 10 towards the plate 40 by radially deforming the walls of the first cylindrical pipe segment. Similarly, secondary end forming may occur as force is applied to the coupler 10, thereby moving the coupler 10 downward in direction A and causing the exposed end 32 of the lead pile segment 30 to push upwardly against the radiused bend 18 of the formed end 19*a*, thus radially deforming the walls of the second cylindrical pipe segment 19 as the exposed end 32 moves towards the plate 40. In the example shown in FIG. 4, the length L5 of the body portions 14*c*, 19*c* of the cylindrical pipe segments 14, 19 are relatively short, which may allow a limited amount of secondary end formation to occur before the ends 21, 32 of the pile segments 20, 30 are stopped by the welds 42 that affix the first and second cylindrical pipe segments 14, 19 to the opposite planar surfaces of the plate 40.

Once the ends 21, 32 of the extension and lead pile segments 20, 30 come into close proximity to the exterior welds 42, the walls of the cylindrical pipe segments 14, 19 are restricted from further radial expansion of the respective body portions 14*c* and 19*c*.

In a preferred embodiment, without intending to be limiting, the initial lengths L6*a*, L6*a* of the formed ends 14*a*, 19*a* may be in the range of at least six to twelve inches (15 to 30 cm). The applicant has found that, although the initial lengths L6*a*, L6*a* of the formed ends 14*a*, 19*a* may be less than six inches, if the initial length L6*a* of each of the formed ends 14*a*, 19*a* is too short, the reduced overlap between the pile segments 20, 30 and the coupler's cylindrical pipe segments 14, 19, prior to or during when the driving force is applied, may cause the pile segments to become unstable and move out of position such that the coupler cannot be installed. Furthermore, if the final length of the overlapping region between the pile segments and the coupler is too short, the coupling may not provide sufficient resistance to the forces acting on the installed pile. These factors, in addition to the factors of the specifications of the installed pile and the lengths of the pile segments used for installation, may inform selection of the initial length of the formed ends of the coupler 10.

Figure 5B:
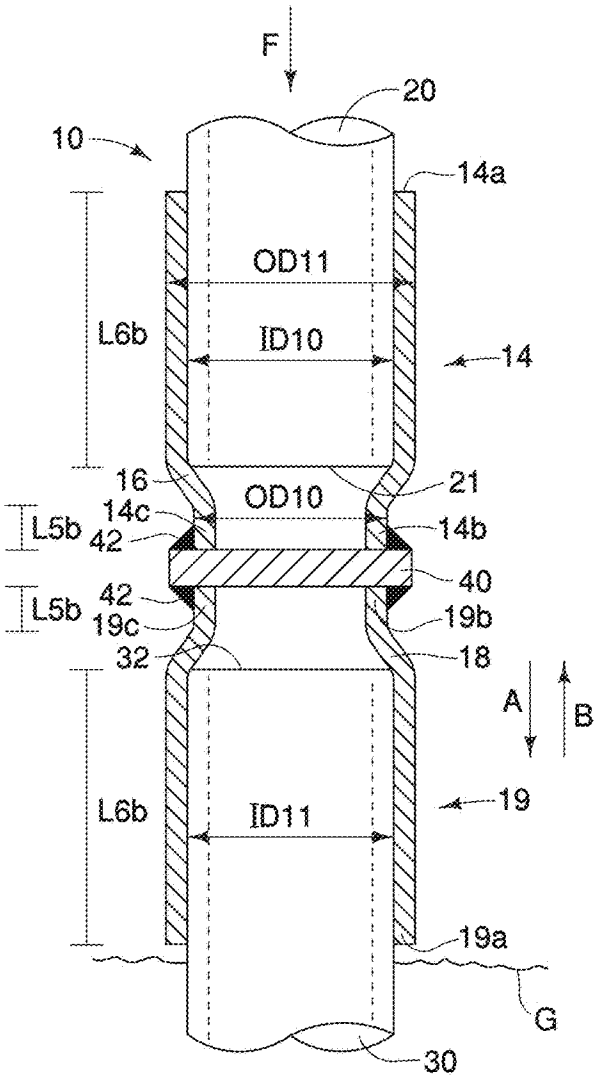
FIG. 5B is a sectional view of the embodiment of a pile coupler illustrated in FIG. 5A, where application of a driving force to the extension pile segment has resulted in secondary end forming at the first and second opposite formed ends of the coupler.
Figure 5A:
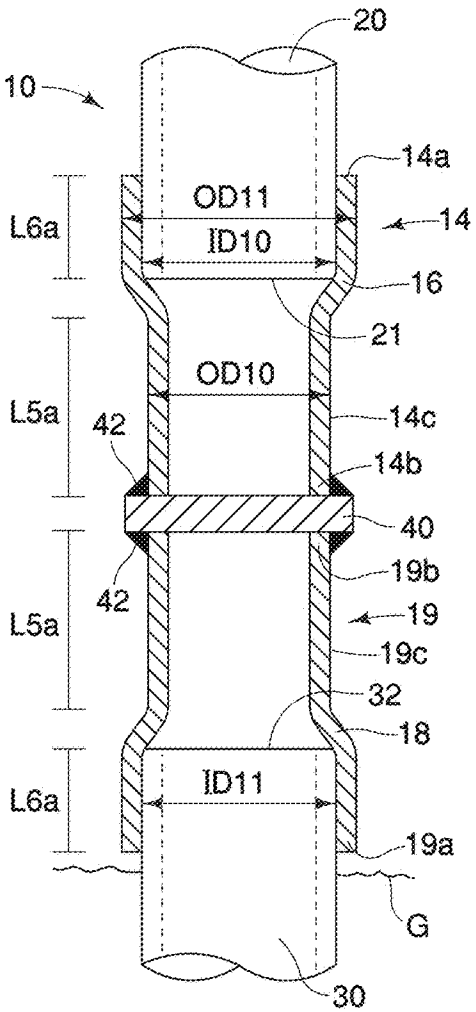
FIG. 5A is a sectional view of the ends of lead and extension pile segments inserted into opposite ends of a further embodiment of a pile coupler, the pile coupler comprising two cylindrical pipe segments welded to plate, the free ends of each cylindrical pipe segment comprising a formed end to provide first and second opposite formed ends of the coupler, wherein the two cylindrical pipe segments of the pile coupler in FIG. 5A are longer than the two cylindrical pipe segments of the pile coupler in FIG. 4.
Figure 4:
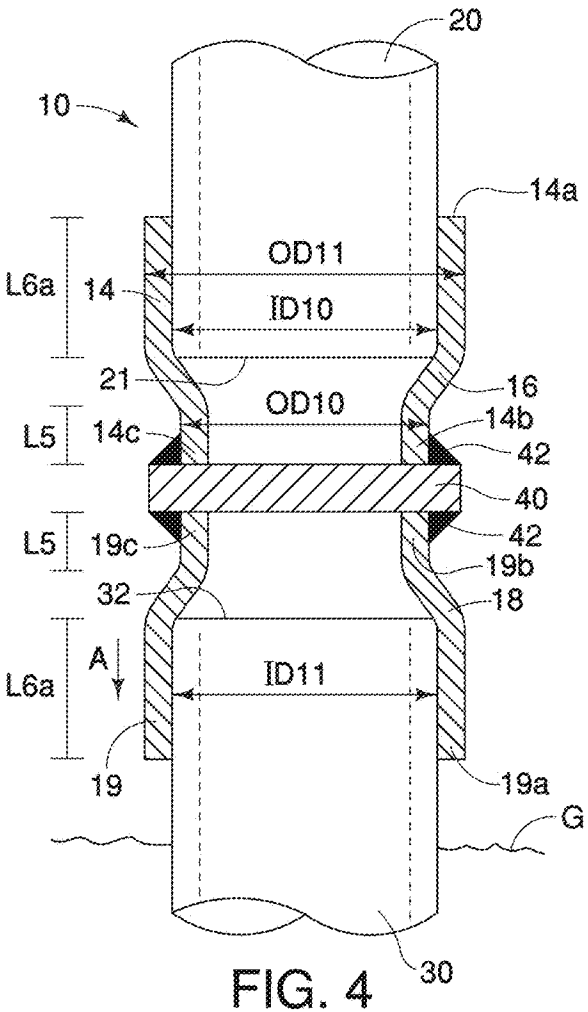
FIG. 4 is a sectional view of the ends of lead and extension pile segments inserted into opposite ends of a further embodiment of a pile coupler, the pile coupler comprising two cylindrical pipe segments welded to plate, the free ends of each cylindrical pipe segment comprising a formed end to provide first and second opposite formed ends of the coupler.

The embodiment illustrated in FIGS. 5A and 5B is similar to the embodiment illustrated in FIG. 4, except that the initial lengths L5*a*, L5*a* of the body portions 14*c*, 19*c* of each cylindrical pipe segment 14, 19, shown in FIG. 5A, is greater than the initial lengths L5, L5 of the body portions 14*c*, 19*c* of each cylindrical pipe segment 14, 19 shown in FIG. 4. When a driving force F is applied to the extension pile segment 20, the end 21 of the extension pile segment 20 pushes against the radiused bend 16 of the formed end 14*a* and thereby radially deforms the walls of the first cylindrical pipe segment 14 in a secondary end forming process. Likewise, the coupler 10 is forced downwardly by the driving force F applied to the extension pile segment 20, therefore causing the exposed end 32 of the lead pile segment 30 to be pushed further into the coupler 10. The exposed end 32 pushes against the radiused bend 18, and when sufficient force F is applied, the exposed end 32 radially outwardly deforms the walls of the second cylindrical pipe segment 19 via a secondary end forming process. As a result of the secondary end forming processes acting on the first and second cylindrical pipe segments 14, 19 of the coupler 10, the final lengths L6*b*, L6*b* of the formed ends 14, 19, as shown in FIG. 5B, are greater than the initial lengths L6*a*, L6*a* of the formed ends 14, 19 shown in FIG. 5A. Similar to the embodiment illustrated in FIG. 4, it appears that the weld seams 42, affixing the plate ends 14*b*, 19*b* of the cylindrical pipe segments 14, 19 to respective opposite planar surfaces of the plate 40, limits the radially outward expansion of each respective cylindrical pipe segment 14, 19 when the ends 21, 32 of the extension and lead pile segments 20, 30 reach a location proximate to the welds 42, thus preventing further secondary end formation.

Figure 6B:
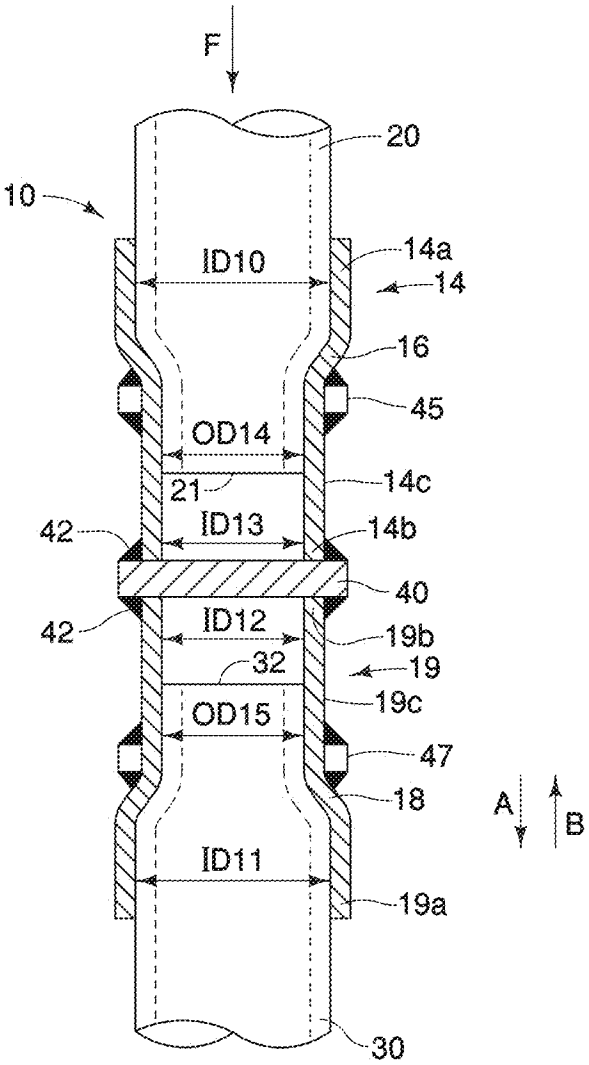
FIG. 6B is a sectional view of the embodiment of a pile coupler illustrated in FIG. 6A, where application of a driving force to the extension pile segment has resulted in secondary end forming and cold extrusion through the external ring sections at the first and second opposite formed ends of the coupler.
Figure 6A:
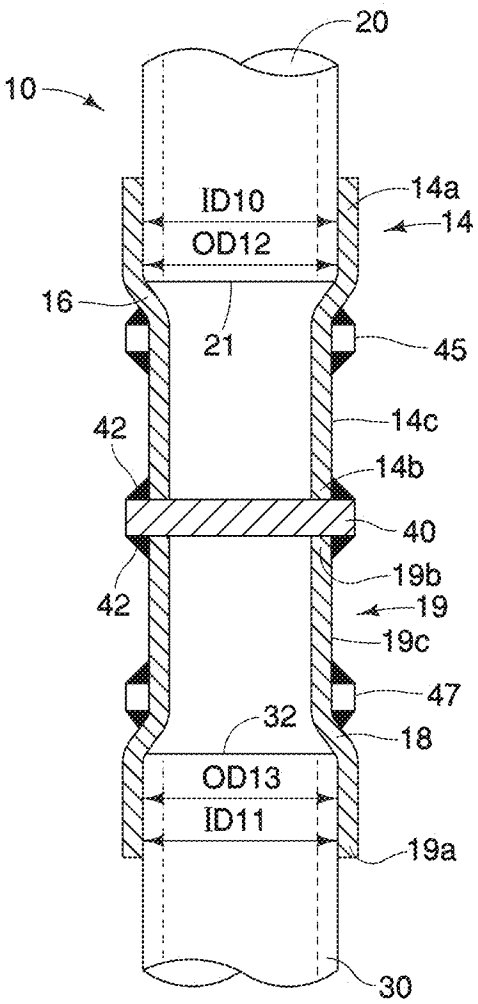
FIG. 6A is a sectional view of the ends of lead and extension pile segments inserted into opposite ends of a further embodiment of a pile coupler, the pile coupler comprising two cylindrical pipe segments welded to plate, the free ends of each cylindrical pipe segment comprising a formed end to provide first and second opposite formed ends of the coupler and first and second external rings positioned and affixed adjacent to the first and second opposite formed ends.

Referring to FIGS. 6A and 6B, a further embodiment of the coupler 10 is similar to the embodiment illustrated in FIGS. 5A and 5B, except that the coupler 10 of FIGS. 6A and 6B further comprises first and second external rings 45, 47 welded or otherwise affixed to an exterior surface of each of the body portions 14*c*, 19*c* of the first and second cylindrical pipe segments 14, 19. As shown in FIG. 6A, before a driving force is applied to the extension pile segment 20, the end 21 of the extension pile segment 20 has an initial outer diameter OD12. The initial outer diameter OD12 of the extension pile segment 20 is approximately equal to the inner diameter ID10 of the formed end 14*a*, such that the end 21 of the extension pile segment 20 is snugly received within the formed end 14*a*. Likewise, the outer diameter OD13 of the end 32 of the lead pile segment 30 is approximately equal to the inner diameter ID11 of the formed end 19*a*, such that the end 32 of the lead pile segment 30 is snugly received within the formed end 19*a*.

When a driving force F is applied to the extension pile segment 20, the end 21 of the extension pile segment pushes against the radiused bend 16 of the formed end 14*a*. However, secondary end forming is prevented by the external ring 45 encircling, and welded to, the exterior surface of the body portion 14*c* of the first cylindrical pipe segment 14, up to a threshold axial driving force. Once that threshold driving force is exceeded, the end 21 of the extension pile segment is radially inwardly compressed, so as to be cold extruded through, the section of the body portion 14*c* that is encircled by the external ring 45, as shown in FIG. 6B. As a result of the cold extrusion process, a final outer diameter OD14 of the end 21 of the extension pile segment 20, as shown in FIG. 6B, is less than the initial outer diameter OD12 of the end 21 of the extension pile segment 20, as shown in FIG. 6A. As well, the final outer diameter OD14 of the end 21 of the extension pile segment 20 is approximately equal to the inner diameter ID13 of the body portion 14*c* of the first cylindrical pipe segment 14.

Likewise, the driving force F is transmitted through the coupler 10 to move the coupler 10 downwardly in direction A. In the initial position before the driving force F is applied, as shown in FIG. 6A, the exposed end 32 of the lead pile segment 30 is resting against the radiused bend 18 of the formed end 19*a*, and the exposed end 32 has an initial outer diameter OD13 that is approximately equal to the inner diameter ID11 of the formed end 19*a*. When the driving force F is applied, as shown in FIG. 6B, the external ring 47, welded to an exterior surface of the body portion 19*c* of the second cylindrical pipe segment 19, prevents the outward radial deformation of the walls of the second cylindrical pipe segment, up to a threshold axial driving force applied to the extension pile segment 20. However, once the axial driving force F exceeds the threshold, the coupler 10 moves downward in direction A, forcing the exposed end 32 of the lead pile segment 30 to compress radially inwardly, and cold extrude through, the section of the body portion 19*c* that is encircled by the external ring 47. As viewed in FIG. 6B, the final outer diameter OD15 of the exposed end 32 is now less than the initial outer diameter OD13 of the exposed end 32 of the lead pile segment 30. The final outer diameter OD15 of the exposed end 32 is approximately equal to the inner diameter ID12 of the body portion 19*c* of the second cylindrical pipe segment 19. As described herein regarding the external ring embodiments of FIGS. 3A and 3B, the Applicant has likewise found that, in respect of the external ring embodiments of FIGS. 6A and 6B, the cold extrusion process occurring at both ends of the coupler 10 described herein may increase the resistance of the installed pile coupling to tension, compression and lateral forces. Additionally, the embodiment shown in FIGS. 6A and 6B includes a plate 40, and the plate and/or the adjacent weld seams 42 may bear some or all of the loads applied to the coupling 10 after installation, further increasing the load limit of the installed pile coupling.

In the embodiments incorporating a plate 40, it will be appreciated that the plate 40 may include a central cut-out (not shown), which would allow for pouring concrete or other materials through the hollow center of the pile segments as may be required for certain applications. It will also be appreciated that the embodiments described herein are not meant to be limiting, but rather, are intended to provide examples of the pile couplings that are included in the scope of the present disclosure. Different combinations of the plate, external ring and formed end characteristics of the pile couplings described herein may be desirable for particular applications and are thus intended to be included in the scope of the present disclosure.

In summary, when the driving force applied to the extension pile exceeds the yield strength of the formed end, secondary end forming may occur (as illustrated, for example, in FIGS. 2A, 2B, 5A and 5B). When secondary end forming occurs, there is increased friction in the resulting coupling, between the inner wall of each of the two formed ends of the coupler and the outer walls of the ends of the lead and extension pile segments, thus providing the pile coupling with higher resistance to compressive, lateral and tension forces acting on the installed pile.

For embodiments in which external rings are added to the coupler, spaced apart from the formed end, the driving (compressive) force applied may be adjusted such that the ends of the extension and lead pile segments perform secondary end forming until the pile segment ends abut against the external ring portion (not shown). In such embodiments, the final length of the formed end of the extension pile, and therefore the extent of secondary end forming that occurs, may be configured by selecting the distance between the respective external rings and the corresponding formed ends of the coupler. Additionally, configuring the pile coupling to have a specified final length of the formed ends (via the secondary end forming process) may also increase the installed pile's resistance to lateral (bending) forces.

Optionally, rather than spacing apart the formed end from the external ring, the coupler may be manufactured so that each external ring abuts against the shoulder of each respective formed end. In such cases, secondary end forming will not occur, but the cold extrusion process will nevertheless provide greater resistance to the tension forces. Examples of such embodiments are shown in FIGS. 3A, 3B, 6A and 6B. In each of the embodiments disclosed herein, the coupler 10 provides for secondary end forming and/or cold extrusion to occur at both ends of the coupler 10, which advantageously provides for two areas of increased frictional engagement to be formed on each installed coupler 10, thereby providing for an overall increase in the resistance of the coupling to lateral (bending), tension and compressive forces acting on the installed pile, as compared to other couplings which provide for only one area of overlap between the coupler and the lead or extension pile segment.

Embodiments of the coupler incorporating a plate positioned in-between the first and second formed ends may offer several advantages. Firstly, the plate provides for controlling the amount of secondary end forming that occurs, by limiting the travel of the ends 21, 32 of the pile segments when a driving force is applied. That is, if the ends 21 or 32 are pushed far enough into the coupler 10 to reach the weld seam 42 between the cylindrical pipe segment and the plate 40, the ends 21 or 32 of the respective extension and lead pile segments 20, 30 will not be able to move further into the coupling 10. Additionally, the plate 40 and/or the weld seam 42 may bear some of the compression and lateral forces applied to the installed pile, which may increase the overall load that the installed pile is capable of bearing. These, and other advantages of the various embodiments described herein, will be recognized by persons skilled in the art.

Further advantageously, for applications requiring coupling together pile segments having different diameters, the inner diameters ID10, ID11 of the formed ends 14*a*, 19*a* of the first and second cylindrical pipe segments 14, 19 may not be equal to one another. Thus, the inner diameters ID10, ID11 of the formed ends 14*a*, 19*a* of any of the embodiments of the coupler 10 having a central plate 40, may be configured to couple with lead and extension pile segments 30, 20 having different outer diameters OD13, OD12. Due to the ease of manufacturing the couplers 10 disclosed herein, which may, for example, be manufactured out of scrap segments of pipe and plates, it is relatively fast and inexpensive to manufacture couplers 10 that are customized to fit lead and extension pipe pile segments of various different diameters.

An additional advantage of the couplers disclosed herein includes that the initial lengths of the formed ends may be configured to provide for improved alignment and stability of the pile segments to be coupled together, prior to applying the driving force F. The initial length of the formed ends, on each end of the coupler 10, may be configured to allow for sufficient overlap between the coupler's formed ends and the ends 21, 32 of the respective extension and lead pile segments 20, 30 to prevent lateral movement of the extension pile segment, relative to the central axis of the lead pile segment, such that the central axes of the lead and extension pile segments are substantially co-linear. Furthermore, there is a snug fit between the coupler's formed ends and the ends 32, 21 of the lead and extension pile segments, whereby the respective outer diameters of the lead and extension pile segments and the inner diameters of the corresponding formed ends of the coupler are approximately equal to one another. The combined features of the relative length of each of the formed ends, and the relatively snug fit between the coupler's formed ends and the ends of the lead and extension pile segments, provides for the self-alignment of the extension pile segment with the lead pile segment, such that the extension and lead pile segments are approximately co-linear when initially inserted into the coupler 10, prior to applying the driving force F.

This self-alignment feature, and the relative stability of the lead and extension pile segments upon initial insertion into the coupler, provides for more consistent alignment of the extension pile segment with the lead pile segment during installation, leading to an installed pile that is capable of bearing higher loads, as compared to an installed pile where the lead and extension pile segments are mis-aligned or bent at a coupling between two segments.

A further advantage of the couplers disclosed herein, is that the couplers provide for increased tension resistance at the coupling, without requiring welding or other mechanical fastening of the coupler to the pile segments. In some embodiments of the present disclosure, eliminating welding or mechanical fastening between the pile segments and the coupler may reduce the time and expense required for installation of the pile segments. Additionally, as some mechanical fasteners and/or associated flanges for some coupling designs may protrude outwardly from the outer diameter of the coupling, such mechanical fasteners or flanges may increase ground disturbance when the coupling is driven beneath the ground surface. This ground disturbance, during pile installation, may require increased driving force for driving the pile, and may result in forming a cavity between the installed pile and the soil. Whereas, the couplers disclosed herein do not require mechanical fasteners or flanges. The coupler disclosed herein may only protrude outwardly of the respective pile segments by the wall thickness of the coupler. Thus, the design of the couplers disclosed herein reduce or eliminate the ground disturbance that may otherwise occur during pile installation using other couplers known in the art.

The couplers and methods disclosed herein are described in language that is more or less specific as to structural and methodical features. It will be appreciated, however, that the present disclosure is not limited to the specific features shown and described, since the specific features herein disclosed comprise preferred forms of implementing the disclosed couplers, and variants on the features described herein are intended to be included in the scope of the present disclosure described, or described and claimed, herein.

Further, aspects herein have been presented for guidance in the construction and/or operation of illustrative embodiments of the disclosure. Applicant considers these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe couplers which include less, more and/or alternative steps than those couplers explicitly disclosed, as well as systems, devices or apparatuses which includes less, more and/or alternative structure than the explicitly disclosed structure.

What is claimed is:

1. A coupler for coupling together a lead pile segment and an extension pile segment of a driven pile, the coupler comprising:

opposite first and second cylindrical formed ends, each end of the first and second cylindrical formed ends opening in an opposite direction of the other formed end;

wherein each of the first and second cylindrical formed ends transition, via a corresponding first or second radiused bend, to an at least one cylindrical hollow member extending between the opposite first and second cylindrical formed ends, wherein the first and second cylindrical formed ends, the at least one cylindrical hollow member and the first and second radiused bends together form a single coupler;

wherein each of the first and second cylindrical formed ends have an inner diameter that is greater than an outer diameter of the at least one cylindrical hollow member;

wherein the first cylindrical formed end is sized to snugly receive an end of the lead pile segment, the lead pile segment bearing against the first radiused bend, and the second cylindrical formed end is sized to snugly receive an end of the extension pile segment, the extension pile segment bearing against the second radiused bend; and wherein the coupler comprises first and second external rings, the first external ring affixed to an external surface of the at least one cylindrical hollow member and proximate to the first radiused bend and the second external ring affixed to the external surface of the at least one cylindrical hollow member and proximate to the second radiused bend of the coupler; and wherein, when an axial force is applied to the extension pile segment to drive the ends of the lead and extension pile segments into the coupler, the end of the lead pile segment is cold extruded through a section of the at least one cylindrical hollow member that is encircled by the first external ring and the end of the extension pile segment is cold extruded through a section of the at least one cylindrical hollow member that is encircled by the second external ring.

2. The coupler of claim 1 wherein the first external ring is affixed to the external surface of the at least one cylindrical hollow member and adjacent to, so as to abut against, the first radiused bend, and wherein the second external ring is affixed to the external surface of the at least one cylindrical hollow member and adjacent to, so as to abut against, the second radiused bend.

3. The coupler of claim 1 wherein the at least one cylindrical hollow member comprises at least one pipe segment.

4. The coupler of claim 1 wherein the at least one cylindrical hollow member comprises a first pipe segment adjacent the first cylindrical formed end and a second pipe segment adjacent the second cylindrical formed end.

5. The coupler of claim 4 wherein each segment of the first and second pipe segments comprises a plate end opposite of the respective first and second cylindrical formed ends, and the coupler further comprising a plate affixed to the plate ends of each of the first and second pipe segments.

6. The coupler of claim 5 wherein a diameter of the plate is substantially equal to an outer diameter of the plate end of the first and second pipe segments.

7. The coupler of claim 5 wherein the inner diameter of the first cylindrical formed end is greater than or less than the inner diameter of the second cylindrical formed end.

8. The coupler of claim 7 wherein the plate has a diameter approximately equal to an outer diameter of the plate end of the first or second pipe segment having the greatest outer diameter.

9. The coupler of claim 5 wherein the first external ring is affixed to an external surface of the first pipe segment between the plate and the first cylindrical formed end and the second external ring is affixed to an external surface of the second pipe segment between the plate and the second cylindrical formed end;

wherein, when the axial force is applied to the extension pile segment the ends of the lead and extension pile segments are driven towards the plate, and the end of the lead pile segment is cold extruded through a section of the first pipe segment that is encircled by the first external ring and the end of the extension pile segment is cold extruded through a section of the second pipe segment that is encircled by the second external ring.

10. The coupler of claim 9 wherein the first external ring is affixed to the external surface of the first pipe segment and adjacent to, so as to abut against, the first radiused bend, and wherein the second external ring is affixed to the external surface of the second pipe segment and adjacent to, so as to abut against, the second radiused bend.

11. The coupler of claim 1 wherein a wall thickness of each of the opposite first and second cylindrical formed ends is equal to or greater than a wall thickness of the corresponding lead pile segment or extension pile segment of the driven pile.

12. The coupler of claim 1 wherein the at least one cylindrical hollow member is at least one elongated cylindrical hollow member.

* * * * *